US005936341A

United States Patent [19]

Koleszár et al.

[11] Patent Number: 5,936,341

[45] Date of Patent: Aug. 10, 1999

[54] SINGLE-ENDED DISCHARGE LAMP

[75] Inventors: Kázmér Koleszár, Dunakeszi; Péter Ormai; Zsolt Micsinai, both of Nagykanizsa; József Tökés; Zoltán Vámos, both of Budapest, all of Hungary

[73] Assignee: General Electric Company, Schenectady, N.Y.

[21] Appl. No.: 08/998,846

[22] Filed: Dec. 29, 1997

[30] Foreign Application Priority Data

Dec. 30, 1996 [HU] Hungary ..... 9603621

[51] Int. Cl.[6] ..... H01J 17/16

[52] U.S. Cl. ..... 313/493; 313/634

[58] Field of Search ..... 313/493, 634, 313/318.02

[56] References Cited

U.S. PATENT DOCUMENTS

| | | | |
|---|---|---|---|
| 4,481,442 | 11/1984 | Albrecht et al. | 313/493 |
| 5,055,738 | 10/1991 | Yorifuji et al. | 313/490 |
| 5,635,794 | 6/1997 | Koerfer | 313/493 |

FOREIGN PATENT DOCUMENTS

| | | |
|---|---|---|
| 0 569 814 A1 | 11/1993 | European Pat. Off. . |
| 0 608 205 A1 | 7/1994 | European Pat. Off. . |
| 35 44465 A1 | 6/1986 | Germany . |
| 92 07 139 | 7/1992 | Germany . |
| 92 07139 U | 7/1992 | Germany . |
| 42 15 674 | 11/1993 | Germany . |
| 192 640 | 1/1989 | Hungary . |
| WO 89/09487 | 10/1989 | WIPO . |

*Primary Examiner*—Nimeshkumar D. Patel

*Attorney, Agent, or Firm*—Fay, Sharpe, Beall, Fagan, Minnich & McKee, LLP

[57] ABSTRACT

The invention relates to a single-ended discharge lamp comprising a discharge tube bordering a discharge space and sealed in a gas-tight manner at its ends and also comprising electrodes, wherein the discharge tube has at least two straight tube portions and a bent connection member between at least some of the adjacent straight tube portions. The bent connection member has an arc-shaped outer and an arc-shaped inner bordering wall, an indentation narrowing the cross-section of the discharge space is formed in the outer bordering wall and the bent connection member has bulged dome portions between its ends connecting to the straight tube portion and the narrowing indentation. The solution is characterized in that the largest cross-section (A2) inside the tube wall of at least one of the dome portions (11*d*) is at least 1.8 times but at maximum 2.2 times the smallest cross-section (A3) inside the tube wall between the arc-shaped inner bordering wall (11*b*) of the bent connection member (11) and the narrowing indentation (11*c*).

8 Claims, 1 Drawing Sheet

SINGLE-ENDED DISCHARGE LAMP

Figure 1:
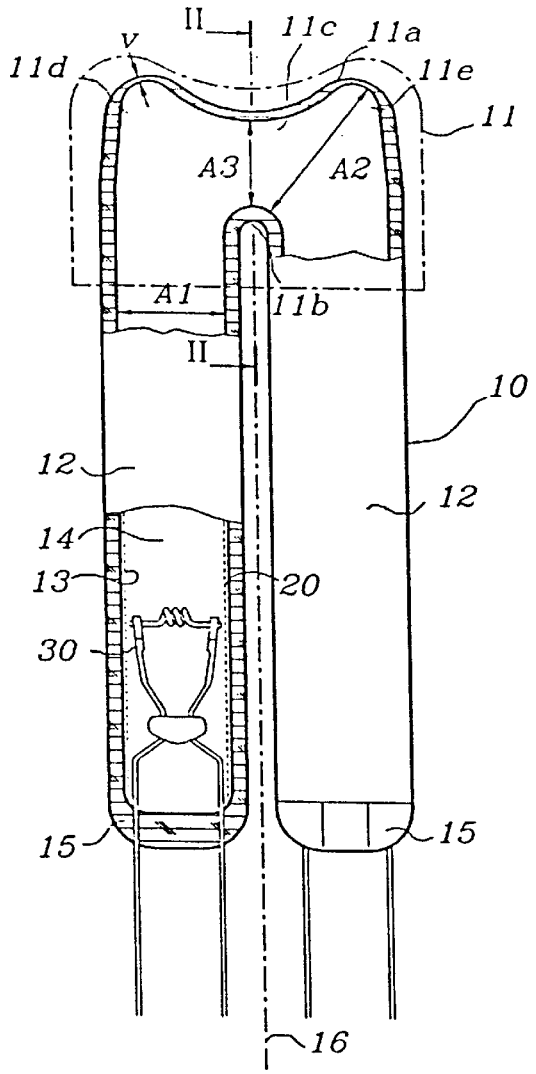

The subject of the invention is a single-ended discharge lamp. This invention relates to the discharge tube of the single-ended discharge lamp.

Single-ended discharge lamps, commonly referred to as compact fluorescent lamps, have a widespread use both for indoor and outdoor lighting. The advantage of these light sources is that they can be operated more economically than the other conventional light sources due to their long life together with their low power consumption.

However, there is a problem occurring during the operation of single-ended low-pressure discharge lamps. Due to the temperature of the plasma generated by the arc discharge, the discharge space is overheated causing the partial pressure of mercury to rise above the optimum value. Excitation of the fluorescent coating will also be inappropriate, therefore the luminous flux of the lamp will be lower than that available in the case of the optimum temperature range.

Several constructions have been created for obtaining the required temperature of about 37° C. of the discharge space. The principle of these constructions is that the partial pressure of mercury can be adjusted by producing an appropriate temperature at the end of the discharge tube close to the bridging connecting two approximately parallel straight tube portions, i.e., in the so-called cold chamber being free of plasma so that the luminous efficiency approaches the optimum value.

Constructions are known in which the temperature required is adjusted by placing and shaping the bridging appropriately. Such a solution is disclosed e.g. in the description of utility model No. DE G 92 07139.2. The essential feature of this construction is that the portion connecting the straight tube portions of the discharge tube has a cross-section narrowing towards the outer arc. This cross-section is substantially parabolic rather than circular.

This solution, however, has the disadvantage that no cold chamber with appropriately low temperature can be produced and the maximum possible luminous flux cannot be achieved despite the constricted plasma due to the parabolic cross-section.

According to patent No. DE P 42 15 674.2, the inner cross-section of the discharge tube is shaped in a specific way that can be helpful in producing and maintaining a favorable partial pressure of mercury.

This construction, however, has the disadvantage that it is troublesome to form the inner tube cross-section and the discharge tube wall in this specific way and to control and produce this discharge tube reliably requires complicated manufacturing and control equipment which increases the cost of the manufacturing process.

Construction of the discharge tube of the discharge lamp described in patent No. HU 192 640 is based on a different principle. In this solution, the middle portion of the bent connection member connecting the straight tube portions of the discharge tube is compressed towards the discharge space to narrow the cross-section of the plasma flow. The narrowing portion is placed between two dome-like cold chambers which results in favorable luminous efficiencies in the case of lamps with small arc current.

Primarily in the case of lamps with high arc current, this construction however has the deficiency that the increased amount of heat generated by the plasma raises the operating temperature and this temperature rise also extends to the vicinity of cold chambers which impairs the luminous efficiency of the discharge lamp.

The objective of the invention is to eliminate the deficiencies of known discharge tube constructions and to create a single-ended discharge lamp construction that allows the partial pressure of mercury to be adjusted appropriately and maximum excitation to be achieved even in the case of single-ended discharge lamps with high arc current which results in an increased luminous efficiency.

The recognition that has led to the solution according to the invention was that the objective set can be achieved by producing specific geometry conditions between the narrowed cross-section of the bent connection member and the largest cross-section of the dome.

The single-ended discharge lamp according to the invention comprises a discharge tube bordering a discharge space and sealed in a gas-tight manner at its end and also comprises electrodes in the said discharge tube. The discharge tube has at least two straight tube portions and a bent connection member between at least some of the adjacent straight tube portions. The bent connection member has an arc-shaped outer and an arc-shaped inner bordering wall. An indentation to narrow the cross-section of the discharge space is formed in the outer bordering wall, and bulged dome portions are formed between the ends of the bent connection member that are connected to the straight tube portion and the narrowed portion. The objective set can be achieved if the largest cross-section inside the tube wall of at least one of the dome portions is at least 1.8 times but at maximum 2.2 times the smallest cross-section inside the tube wall between the arc-shaped inner bordering wall of the bent connection member and the narrowed portion.

In a possible embodiment of the discharge lamp according to the invention, the largest cross-section inside the tube wall of at least one of the dome portions is at least 1.2 times but maximum 1.7 times the cross-section inside the tube wall of the straight tube portion.

In a preferred embodiment of the discharge lamp according to the invention, the outer and the inner bordering wall of the bent connection member are connected with each other through flattened side walls.

It is preferable if the flattened side walls have plane surfaces and the angle they make falls between 30° and 50°.

In another preferred embodiment of the discharge lamp according to the invention, the wall thickness of the outer bordering wall of the discharge tube is 0.15 to 0.25 mm in the vicinity of the dome portion.

In a further embodiment of the discharge lamp according to the invention, the number of the straight tube portions of the discharge tube is at least four.

In an even further embodiment of the discharge lamp according to the invention, the inner surface of the discharge tube is provided with a phosphor layer.

The single-ended discharge lamp according to the invention has several advantageous features. The most important one of these is that, by keeping the favorable ratio of the cross-section of the dome portion to the narrowed cross-section of the discharge tube, the average value of about 37° C. of the discharge tube temperature being necessary to attain the maximum excitation can be adjusted even in the case of single-ended discharge lamps with high arc current which allows better luminous efficiencies than those of the known ones to be achieved.

It is a further advantage that an additional improvement of luminous efficiency can be achieved if the bent connection member meeting the requirement for the ratios of cross-sections has a cross-section with specifically flattened shape. In addition, this part of the discharge tube, which is otherwise most sensitive to breakage, will be less fragile. This advantage makes the manufacturing process, transportation and storing simpler and reduces the shrinkage coming from breaks and cracks.

It should also be considered as an advantage that, due to the geometry according to the invention, the overall length of the lamp can be shortened to achieve the same luminous flux as that of the known constructions which results in a further cost reduction.

Figure 2:
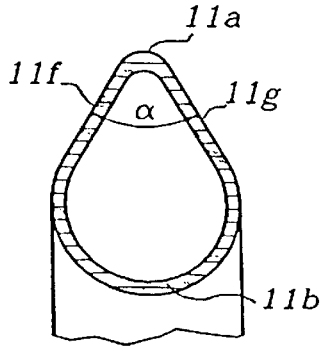

In the following, the invention will be described in more detail using an embodiment illustrated by a drawing in which FIG. 1 is a side view of a preferred embodiment of the single-ended discharge lamp according to the invention partly in section and FIG. 2 is the section of the discharge tube according to FIG. 1 taken along the plane II—II.

FIG. 1 shows discharge tube 10 of the single-ended discharge lamp. Straight tube portions 12 substantially parallel to each other and the number of which is two in this case are shown. Their ends are connected by a bent connection member 11. The lower ends of the straight tube portions 12 are terminated by pinched portions 15 making a gas-tight seal, and electrodes 30 are embedded in these pinched portions 15.

A discharge tube is also conceivable that is composed of four, six, eight or even more straight tube portions 12 connected to each other in a way enabling a discharge to take place. In these, at least some of the intermediate straight tube portions 12 are also connected to each other by the bent connection members 11. In the example, however, only the simplest construction is described for better understanding.

Surface 13 of the discharge tube 10 being on the discharge space 14 side is covered by a coating layer, e.g., a fluorescent phosphor. The bent connection member 11 of the discharge tube 10 has an arc-shaped outer bordering wall 11*a*, an also arc-shaped inner bordering wall 11*b* and, as shown in FIG. 2, flattened side walls 11*f*, 11*g* which connect the outer bordering wall 11*a* and the inner bordering wall 11*b*.

It is seen in FIG. 1 that the outer bordering wall 11*a* of the bent connection member 11 has, in the vicinity of longitudinal axis 16 of the discharge tube 10, an indentation 11*c* narrowing towards the discharge space 14, and bulged dome portions 11*d* and 11*e* are placed on both sides of the narrowing indentation 11*c* of the bent connection member 11.

The dome portions 11*d* and 11*e* are formed so that their largest cross-section A2 inside the tube wall is at least 1.8 times and at maximum 2.2 times the smallest cross-section A3 measured inside the tube wall between the narrowing indentation 11*c* and the inner bordering wall 11*b*. In the single-ended discharge lamp of FIG. 1, the present invention is embodied so that the largest cross-section A2 inside the tube wall is twice the smallest the cross-section A3.

Based on our tests, this ratio of the cross-sections ensures optimum operating conditions in respect of the luminous efficiency of the single-ended discharge lamp.

In the present embodiment the largest cross-section A2 inside the tube wall of the dome portions 11*d* and 11*e* of the bent connection member 11 is 1.4 times the cross-section A1 inside the tube wall of the straight tube portion 12 of the discharge tube 10.

It is also seen in FIG. 1 that the wall thickness "v" of the outer wall 11*a* bordering the dome portions 11*d* and 11*e* of the bent connection member 11 is the thinnest portion of the wall of the discharge tube 10. This wall thickness is preferably 0.2 mm in this embodiment.

FIG. 2 illustrates that the flattened side walls 11*f* and 11*g* between the outer bordering wall 11*a* and the inner bordering wall 11*b* of the bent connection member 11 are convergent towards the outer bordering wall 11*a*. The angle "α" between the flattened side walls 11*f* and 11*g* is 30° to 50°. This angle is preferably 45° in this embodiment.

During the operation of the discharge lamp described by means of FIGS. 1 and 2, the plasma produced by the arc discharge taking place in the discharge space 14 between the electrodes 30 is constricted in the bent connection member 11. The constriction takes place owing to the geometry conditions produced by the narrowing indentation 11*c* and the converging flattened side walls 11*f* and 11*g*. The plasma will be placed along the inner bordering wall 11*b* of the bent connection member 11. The heat radiated by the constricted plasma will be removed at the dome portions 11*d* and 11*e* due to their cross-section mentioned earlier and the thin wall thickness "v" formed in the vicinity of the dome portions 11*d* and 11*e*, and so the temperature of the dome portions 11*d* and 11*e* is stabilized at about 25° C.

This temperature allows the average temperature of the discharge space of the discharge tube 10 to be about 37° C. This produces a partial mercury vapor pressure that results in the maximum intensity of the 253.7 nm mercury line necessary for the light generation. Due to this, the luminous efficiency of single-ended discharge lamps even with high arc current, i.e., 300 mA or more will be significantly more favorable.

The embodiments are shown for the purpose of the illustrating the invention and are not intended to restrict the scope of protection. It is intended that the scope of protection be determined by the appended claims.

We claim:

1. Single-ended discharge lamp comprising a discharge tube bordering a discharge space and sealed in a gas-tight manner at its ends and also comprising electrodes, wherein the discharge tube has at least two straight tube portions and a bent connection member between at least some of the adjacent straight tube portions, the bent connection member has an arc-shaped outer and an arc-shaped inner bordering wall, an indentation narrowing the cross-section of the discharge space is formed in the outer bordering wall and the bent connection member has bulged dome portions between its ends connecting to the straight tube portion and the narrowing indentation characterized in that the largest cross-section (A2) inside the tube wall of at least one of the dome portions (11*d*) is at least 1.8 times but at maximum 2.2 times the smallest cross-section (A3) inside the tube wall between the arc-shaped inner bordering wall (11*b*) of the bent connection member (11) and the narrowing indentation (11*c*).

2. Discharge lamp according to claim 1 characterized in that the largest cross-section (A2) inside the tube wall of at least one of the dome portions (11*d*) is at least 1.2 times but at maximum 1.7 times the cross-section (A1) inside the tube wall of the straight tube portion (12).

3. Discharge lamp according to claim 1 characterized in that the outer bordering wall (11*a*) and the inner bordering wall (11*b*) of the bent connection member (11) are connected to each other by flattened side walls (11*f*, 11*g*).

4. Discharge lamp according to claim 3 characterized in that the flattened side walls (11*f*, 11*g*) have a plane surface.

5. Discharge lamp according to claim 3 characterized in that the angle (α) made by the flattened side walls (11*f*, 11*g*) is between 30° and 50°.

6. Discharge lamp according to claim 1 characterized in that the wall thickness (v) of the outer bordering wall (11*a*) of the discharge tube (10) is 0.15 to 0.25 mm in the vicinity of the dome portion (11*d*).

7. Discharge lamp according to claim 1 characterized in that the number of the straight tube portions (12) of the discharge tube (10) is at least four.

8. Discharge lamp according to claim 1 characterized in that the inner surface (13) of the discharge tube (10) is provided with a phosphor layer (20).

* * * * *